US005170650A

United States Patent [19]

Kortenbrede

[11] Patent Number: 5,170,650

[45] Date of Patent: Dec. 15, 1992

[54] LOCKING DEVICE FOR A LOCK, ESPECIALLY FOR A RING LOCK

[75] Inventor: Ludger Kortenbrede, Telgte, Fed. Rep. of Germany

[73] Assignee: Aug. Winkhaus GmbH & Co. KG, Telgte, Fed. Rep. of Germany

[21] Appl. No.: 574,292

[22] Filed: Aug. 28, 1990

[30] Foreign Application Priority Data

Aug. 29, 1989 [DE] Fed. Rep. of Germany ..... 3928545
May 28, 1990 [DE] Fed. Rep. of Germany ..... 4017122

[51] Int. Cl.[5] ..... E05B 67/06

[52] U.S. Cl. ..... 70/49; 70/386; 70/54

[58] Field of Search ..... 70/32–49, 70/54, 55, 379 R, 379 A, 386, DIG. 62

[56] References Cited

U.S. PATENT DOCUMENTS

| | | | |
|---|---|---|---|
| 1,350,392 | 8/1920 | Taylor | 70/43 |
| 1,419,469 | 6/1922 | Paschke | 70/49 |
| 1,692,826 | 11/1928 | Ganz | 70/386 |
| 1,722,525 | 7/1929 | Junkunc . | |
| 3,143,872 | 8/1964 | Check | 70/38 |
| 3,186,196 | 6/1965 | Moberg | 70/34 |
| 3,187,525 | 6/1965 | Dies | 70/38 |
| 3,221,526 | 12/1965 | Stackhouse | 70/437 |
| 3,435,642 | 4/1969 | Del Pesco | 70/49 |
| 3,499,301 | 3/1970 | Niilola et al. | 70/52 |
| 3,738,132 | 6/1973 | Nagel | 70/49 |
| 3,835,675 | 9/1974 | Lippisch | 70/38 A |
| 3,855,824 | 12/1974 | Falk | 70/49 X |
| 3,952,565 | 4/1976 | Falk | 70/417 |
| 3,995,459 | 12/1976 | Weeks et al. | 70/34 X |
| 4,015,456 | 4/1977 | Moberg | 70/34 |
| 4,325,238 | 4/1982 | Scherbing | 70/49 X |
| 4,637,234 | 1/1987 | Mielonen | 70/34 |
| 4,658,606 | 4/1987 | Tseng | 70/38 A |
| 4,831,849 | 5/1989 | Kortenbrede | 70/49 |
| 4,850,207 | 7/1989 | Ylven | 70/49 |
| 4,944,168 | 7/1990 | Kortenbrede | 70/54 X |
| 5,027,630 | 7/1991 | Stillwagon et al. | 70/386 X |

FOREIGN PATENT DOCUMENTS

| | | | |
|---|---|---|---|
| 962322 | 10/1956 | Fed. Rep. of Germany . | |
| 1703572 | 10/1973 | Fed. Rep. of Germany . | |
| 3108606 | 2/1982 | Fed. Rep. of Germany . | |
| 3400426 | 7/1984 | Fed. Rep. of Germany . | |
| 3905353 | 8/1990 | Fed. Rep. of Germany | 70/386 |
| 876347 | 11/1942 | France | 70/49 |
| 1182974 | 3/1970 | United Kingdom | 70/386 |
| 1567322 | 5/1980 | United Kingdom . | |
| 1596781 | 8/1981 | United Kingdom . | |

*Primary Examiner*—Alexander Grosz
*Assistant Examiner*—Suzanne L. Dino
*Attorney, Agent, or Firm*—Brumbaugh, Graves, Donohue & Raymond

[57] ABSTRACT

In the case of a locking device for a lock, especially a ring lock, comprising a connecting part (14) and a connecting part case (16) with a snap-in locking device (22, 24, 30), operated with a locking mechanism (32) a ratchet body (22) is accomodated in a guide passage (26) of a ratchet body guide element (24) oriented transversely to the direction of insertion of the connecting part (14) and is opposite a guide surface (30 at 31) at its side remote from the inserted connecting part (14). The guide surface (30), when the ratchet body guide element (24) is in a locking position, urges the ratchet body (22) behind a ratchet shoulder (20) of the connecting part (14) into an engagement position which prevents withdrawal of the connecting part (14). The ratchet body guide element (24) is movable into a first evasion position by means of the ratchet body (22) engaging the connecting part (14) during insertion of the latter, in which the ratchet body (22) is released to make an evasion movement by means of the guide surface (30 at 48). The ratchet body guide element (24) is rotatable when the locking mechanism (32) is twisted to a second evasion position in which the ratchet body (22) is released for an evasion movement allowing withdrawal of the connecting part (14) by means of the guide surfaces (30).

31 Claims, 4 Drawing Sheets

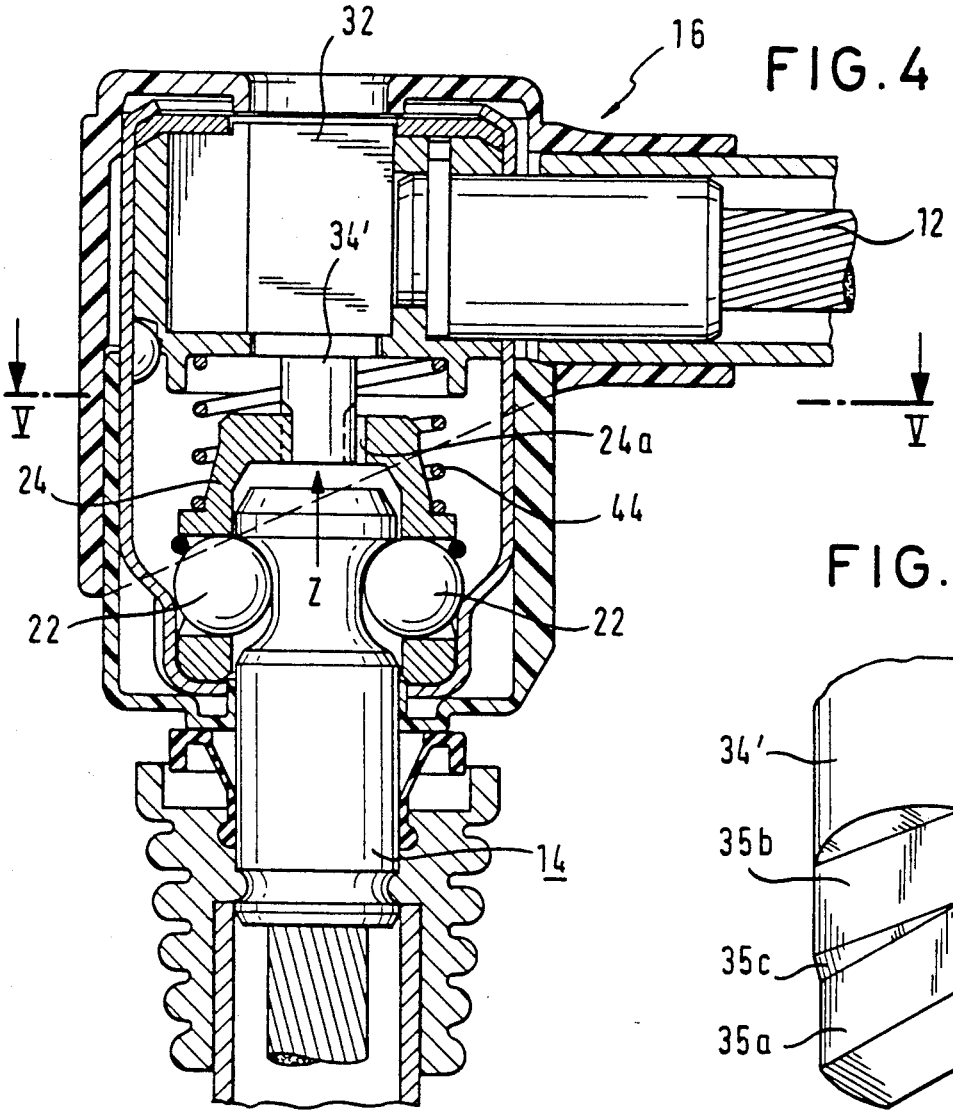
FIG. 4
FIG. 6a
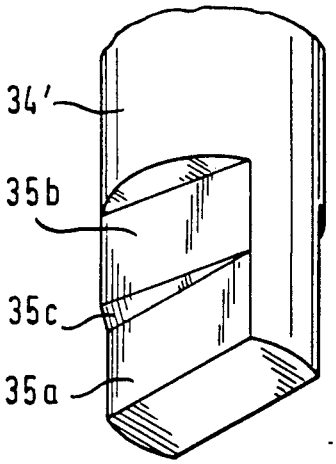
FIG. 5
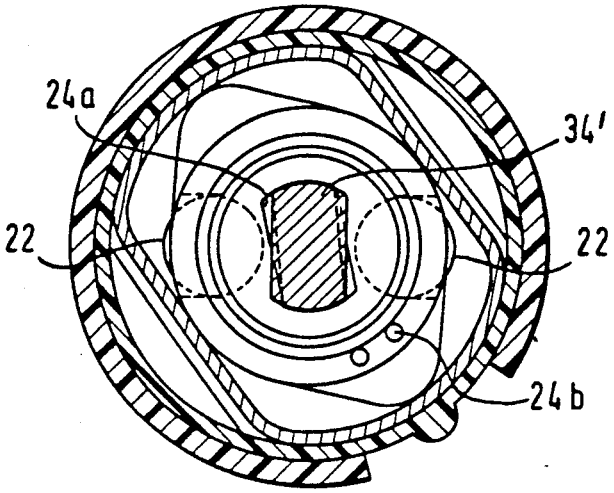
FIG. 6b
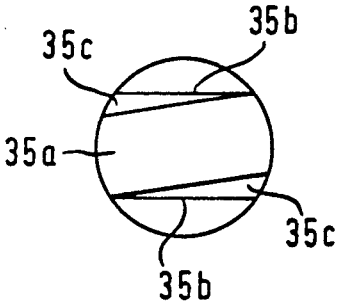

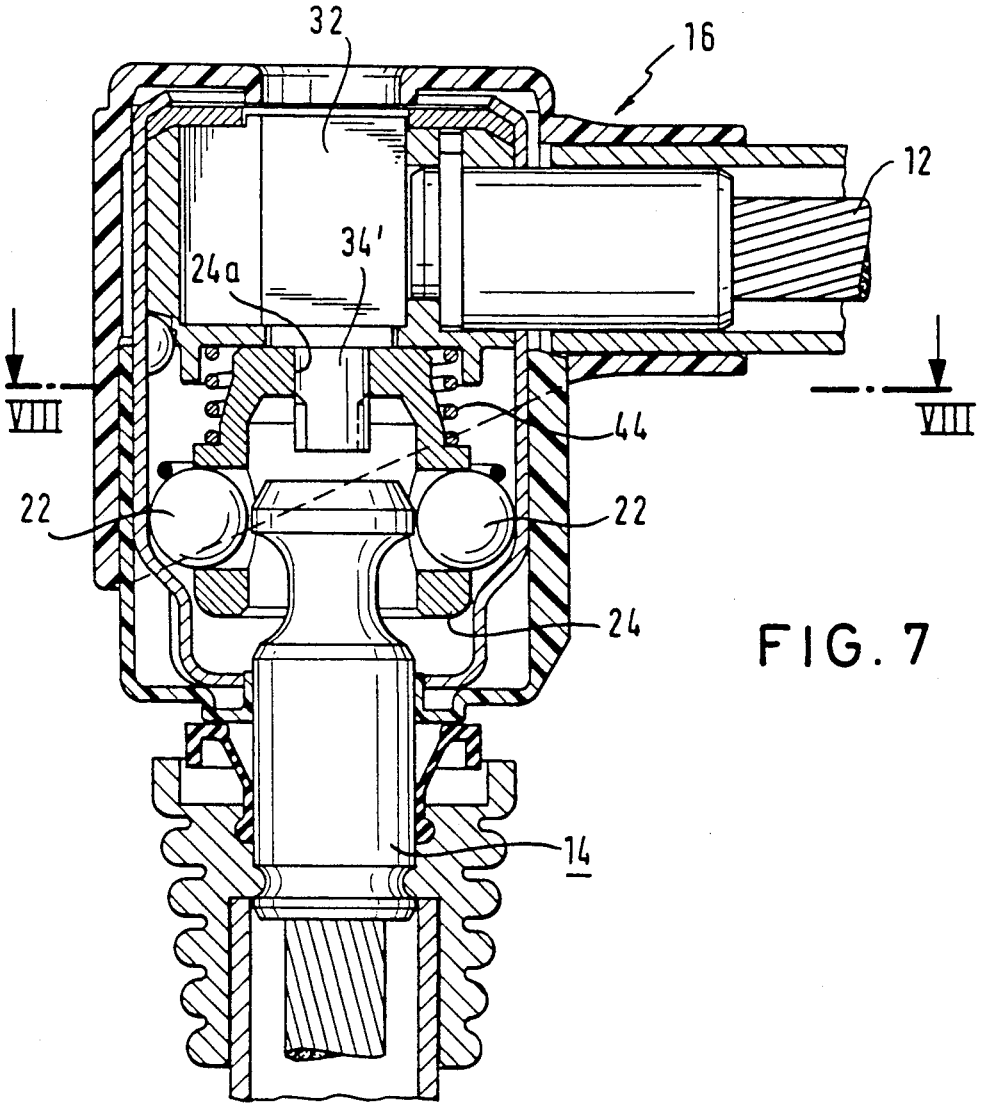
FIG. 7
FIG. 8
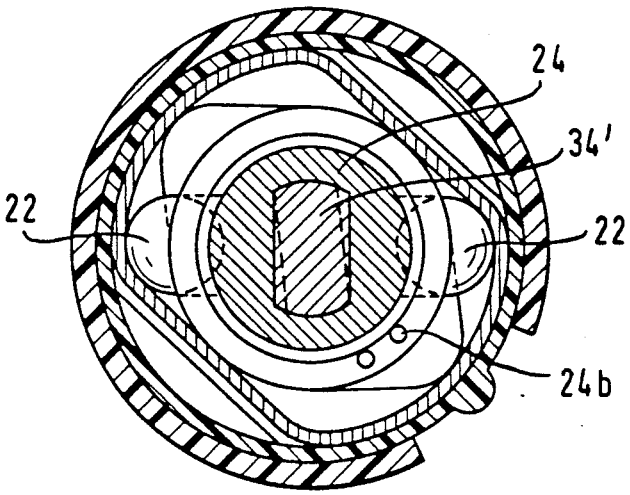

LOCKING DEVICE FOR A LOCK, ESPECIALLY FOR A RING LOCK

BACKGROUND OF THE INVENTION

The invention relates to a locking device for a lock, especially for a ring lock, comprising a connecting part and a connecting part case with a snap-in locking device operated with a locking mechanism, which allows in a basic position of the locking mechanism insertion of the connecting part, but prevents withdrawal of the connecting part and which allows in an open state of the locking mechanism withdrawal of the connecting part, a ratchet shoulder fitted to the connecting part and the snap-in locking device having at least one ratchet body being transversely movable and lockable with respect to the inserting direction of the connecting part to engage behind the ratchet shoulder.

STATEMENT OF THE PRIOR ART

In practice, such a locking device is known to be used in cable locks for bicycles. In this case, one end of the cable is tightly connected with the connecting part case. The connecting part case comprises the locking mechanism which is disposed in a housing and pretensioned in the basic position. Furthermore, an insertion passage for the connecting part is provided in the housing. In case of this locking device, the ratchet body has an L-shaped form with the longer portion of the L partly projecting into the insertion passage through a recess. The other end of the cable is likewise tightly connected to the connecting part. To secure the lock, the connecting part is inserted into the insertion passage urging the L-shaped ratchet body from the insertion passage until such time as the ratchet shoulder has passed the ratchet body. Now the pretensioned ratchet body can swing into the insertion passage again. In case of an attempt being made to pull out the connecting part against the insertion movement, the ratchet shoulder takes its bearing on the ratchet body. A further extraction movement of the connecting part is thereby prevented. When the lock is to be opened, the ratchet body is turned out of the insertion passage and thus releases the connecting part which can now be pulled out. In case of this locking device, it is disadvantageous that the ratchet body supports itself on one edge of the recess in the insertion passage after being engaged. Should an attempt be made to withdraw the connecting part with great force when the lock is engaged, the ratchet body can shear off at this edge. To fulfil its function as a theft protection, such a lock has to have both the ratchet body and the housing massively and solidly constructed. Furthermore, the ratchet body is only insufficiently guided in the housing, which does not exclude the possibility of malfunction.

OBJECT OF THE INVENTION

The invention is based on the problem of so building a locking device of the type mentioned at the outset that the disadvantages of the state of the art outlined are overcome.

SUMMARY OF THE INVENTION

The aforementioned problem is resolved in that the ratchet body is accommodated in a guide passage of a ratchet body guide element orientated transversely to the direction of insertion of the connecting part and is opposite a guide surface at its side remote from the inserted connecting part. In a locking position of the ratchet body guide element, the guide surface urges the ratchet body behind the ratchet shoulder into an engagement position which prevents withdrawal of the connecting part. Furthermore, the ratchet body guide element is movable into a first evasion position upon engagement of the ratchet body with the connecting part during insertion of the latter, in which the ratchet body is released to make an evasion movement by means of the guide surface. The ratchet body guide element is rotatable into a second evasion position by twisting the locking mechanism at which position the ratchet body is released for an evasion movement allowing withdrawal of the connecting part by means of the guide surface.

The particular advantage of the solution according to the invention is that it offers a variety of possibilities for constructive embodiment. The suggested solution particularly offers the condition that, according to an embodiment which will be discussed later, several ratchet bodies can be put to use at the same time without losing the possibility to insert the connecting part leading to an engagement with the locking device in the basic position.

To reach the locking position automatically after the insertion of the connecting part, it is suggested that the ratchet body guide element is pretensioned at the locking position.

If the ratchet body guide element is simultaneously pretensioned in axial and circumferential direction by a coil spring, it is thus secured by means of a single pretension element that the ratchet body guide element not only reaches the locking position automatically after the insertion of the connecting part, but it is also automatically brought back into a ready position for locking after opening the lock.

If the guide surface is formed by an inner side of a housing of the connecting part case, the device has on the whole a simple structure and small outside dimensions and provides optimal protection against dirt ingress.

To ensure easy connection between the ratchet body guide element and the locking mechanism, on the one hand, and to ensure the axial evasion movement of ratchet body guide element, on the other, it is suggested that the ratchet body guide element be guided for axial movement on a pivoted part of the locking mechanism and that it be in rotation-catching connection with this pivoted part.

Since the ratchet body guide element is guided in its axial and rotatable movements by parts of the guide surface, malfunction owing to a bad or non-existing guidance of the ratchet body guide element is avoided.

One or more, in fact just two, ratchet bodies can be provided to engage the lock. In case there are several ratchet bodies, it is advisable that they are almost evenly spread out over the circumference of the connecting part. In this case, when trying to withdraw the connecting part without actuating the locking mechanism, an especially favourable annular load occurs. The ratchet bodies can have different geometrical shapes. Barrel-shaped rollers can be used for example. It is particularly advantageous when the ratchet body or bodies have the shape of a ball.

The ratchet body guide element can have different shapes. It is especially advantageous when the ratchet body guide element is bell-shaped is in a rotation-catching connection with the pivoted part of the locking mechanism at the angular point of the bell and is movable in relation to this pivoted part in the direction of its axis. This shape is optimally suited to the function of the element.

Since the housing of the ratchet body guide element encloses the locking mechanism, the ingress of dirt into the mechanism is prevented and thus its malfunction avoided.

In order to obtain a locking device as small as possible, it is necessary that the coil spring is supported by the locking mechanism.

The locking device according to the invention can be used for many different purposes. If the connecting part and the connecting part case are each connected to one of the ends of a cable of a ring lock, the locking device can, for example, be used as a bicycle lock. On the other hand, it is possible to replace the cable with a chain or a long shackle, but also any other connection between the connecting part and the connecting part case is conceivable. If the end of the cable related to the connecting part case is anchored in an inner housing which encloses the locking mechanism, possibly with an armourplated or reinforcement function, inside an outer housing of the connecting part case, then this is an additional theft protection.

To support the automatic engagement, it is suggested that the ratchet body be pretensioned by biassing means in the direction of engagement with the connecting part. This measure also enables unauthorised attempts to open the lock more difficult through the acceleration of the connecting part case and the effect of tensile force towards the connecting part. In case of several ratchet bodies, the pretension can be effected in the simplest way by means of an elastic ring, for example by means of an O-ring.

To make locking and opening of the lock possible in a single fluent movement, it is suggested that the different guide surface areas of the guide surface cooperating with the ratchet body be joined to each other by curves. Additionally, or on its own, it can also be provided for a displacement bevel for the ratchet body to be situated at the inserting end of the connecting part.

To reach its basic position again after being operated, it is advantageous that the locking mechanism be elastically pretensioned at its basic position. Any known type can be used as a locking mechanism. It is particularly effective when it is a key-operated locking mechanism, especially a cylinder lock.

If the connecting part possesses an axial mobility in relation to the ratchet body, the ratchet body being engaged behind the ratchet shoulder, then the ratchet shoulder can strike against the ratchet body in case the locking device is exposed to vibrations which can, for example, occur when the locking device is used as a cable lock for bicycles and when this lock is carried on the bicycle while riding. Apart from the disturbing noise, the ratchet body and/or the ratchet shoulder can therefore be damaged in the course of the time, which makes a malfunction of the locking device possible. To avoid this, it is suggested that a spring element is provided between the connecting part and the connecting part case which forces the ratchet shoulder when in the locking position, to bear against on the ratchet body.

A particularly simple assembly of the spring element is facilitated when the spring element is fixed to the connecting part and is constructed to bear on a bearing surface of the connecting part case. The spring element can, in this case, be annular and made of silicone rubber, being a cheap material and particularly easy to form.

To avoid the ingress of dirt to the connecting part case through the insertion aperture of the connecting part, it is suggested that the spring element be constructed as a seal element, so as to form a seal between the connecting part and the connecting part case when the connecting part is inserted.

If the housing of the connecting part case is of metal, it can easily corrode. To prevent this, it is furthermore suggested that the connecting part case be enclosed by a rubber or a plastic coating or casing. In this case, the rubber or plastic coating can constitute an additional theft protection, as this material is particularly tough and difficult to cut.

The rubber or plastic coating can, for instance, be shrunk onto the connecting part case. A particularly simple assembly of the coating can be obtained when the rubber or plastic coating is composed of at least two parts being connected, and preferably engaged, with each other.

If the locking device is used for a bicycle lock which has the connecting part case and the connecting part connected to each other by means of a ring cable preferably made out of wire cable, it might be necessary to protect the cable against corrosion. Therefore, it is suggested that the rubber or plastic coating is connected to a tube surrounding a ring cable. If the tube is made of a tough material, it is likewise a further theft protection.

In order to prevent an unintended opening of the locking device as a result of the effect of high forces of gravity, especially where such forces occur unexpectedly, a very strong spring can be provided as a biassing means. This, however, leads to the fact that the insertion of the connecting part is only possible with a large expenditure of energy. To develop the spring in a way that the connecting part can be easily inserted and nevertheless to make the locking device resistant to forces of gravity of such kind, it is furthermore suggested that a catch mechanism be provided between the pivoted part and the ratchet body guide element which allows axial movement of the ratchet body guide element in relation to the pivoted part when the connecting part is inserted by hand into the connecting part case and which, however, blocks an impulsive axial movement of the ratchet body guide element in relation to the pivoted part, such as for instance, through acceleration of the connecting part case.

The structure of the catch mechanism can vary a lot. It can be provided that the guidance between the ratchet body guide element and the pivoted part is constructed with means which impart twisting, so that an axial movement of the ratchet body guide element in relation to the pivoted part is accompanied by by a relative. rotational movement of both parts. In this case there is the possibility that the pivoted part in the locking position engages with a portion of smaller cross section in a rotation-catching aperture of the ratchet body guide element, thereby admitting a free motion of a swing angle which is removed by means of a rotational pretension, and that the pivoted part in the first evasion position engages with a portion of larger cross-section in the rotation-catching aperture, roof-like transitional surfaces being provided at the transition from the portion of small cross-section to the portion of larger cross-section, which force a relative torsion of the pivoted part and the ratchet body guide element when the portion of larger cross-section engages in the rotation-catching aperture. But there is also the possibility that the catch mechanism may be formed by an attenuation mechanism which is suitable for it.

BRIEF DESCRIPTION OF THE DRAWINGS

Examples of embodiments of the invention are explained in greater detail hereinafter with reference to the accompanying drawings, in which:

FIG. 4 shows a further modification of the embodiment in FIG. 1;

FIG. 5 shows a cross-section taken along the line V—V in FIG. 4;

FIG. 6*a* shows an enlarged perspective depiction of a pivoted part shown in FIG. 4 in the direction of arrow Z in FIG. 4;

FIG. 6*b* shows a bottom view of the pivoted part shown in FIG. 6*a;*

FIG. 7 shows a longitudinal section through the locking device shown in FIG. 4, one connecting part being in its first evasion position; and FIG. 8 shows a cross-section taken along the line VIII—VIII in FIG. 7.

DETAILED DESCRIPTION OF THE PREFERRED EMBODIMENTS

Figure 1:
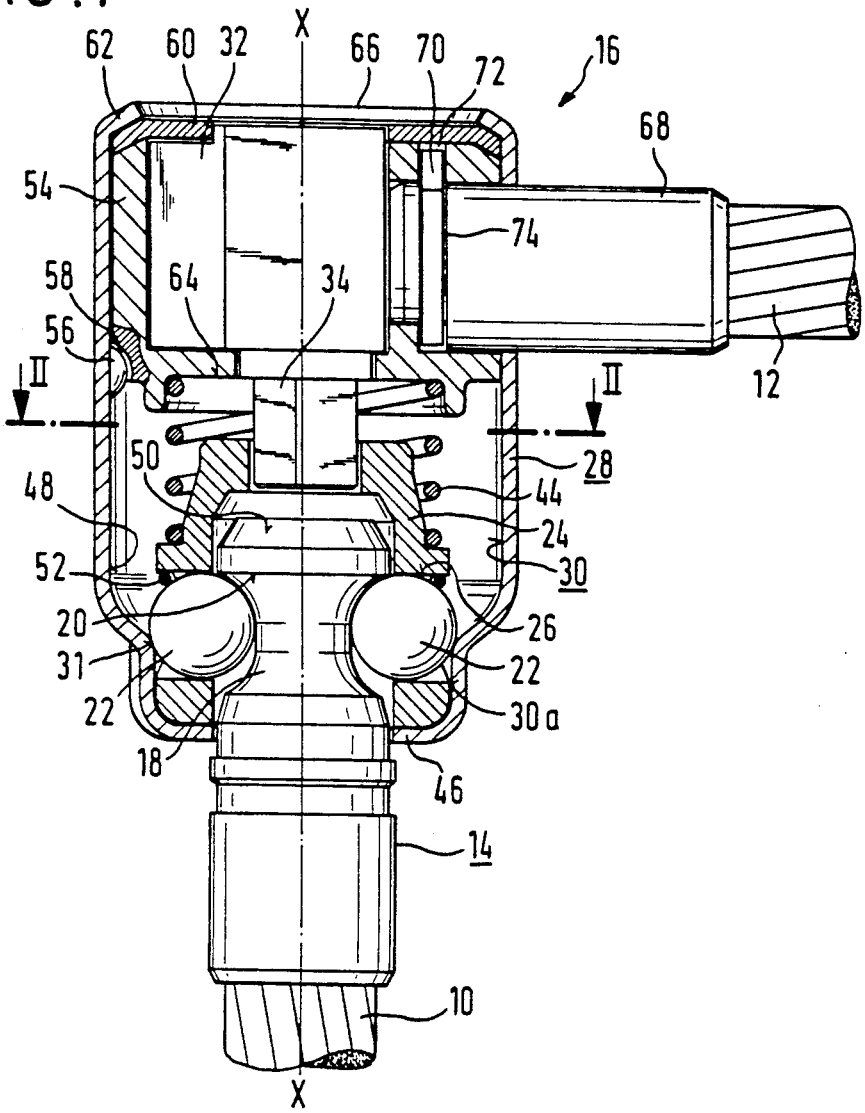
FIG. 1 shows a longitudinal section through a locking device in the locked state according to the invention.

In FIG. 1 a locking device for a cable ring lock is shown, the ends of a locking cable being designated 10 and 12. Respectively, one end 10 of the locking cable is connected to a connecting part 14, and the other end 12 of the locking cable is connected to a connecting part housing or a connecting part case, which is generally designated 16.

The connecting part 14 has a throat 18 with a ratchet shoulder 20. This ratchet shoulder 20 engages behind ratchet balls 22 (engagement position of the ratchet balls) which form ratchet bodies and which are enclosed in a bell-shaped ratchet body guide element 24, i.e. in guide passages 26 of the ratchet body guide element 24. The ratchet body guide element 24 is accommodated inside a housing 28 of the connecting part case 16. In the state according to FIGS. 1 and 2 (locking position of the ratchet body guide element 24), the ratchet balls 22 are not movable radially outwards, because they bear on guide surface areas 31 of a guide surface 30 disposed at an inner side of the housing 28. The ratchet balls 22, the ratchet guide element 24 and the guide surface 30 are parts of a snap-in locking device.

The ratchet body guide element 24 is, in the state in FIG. 1, secured against rotation around the axis X—X by means of a key-operated locking mechanism 32, i.e. by a locking cylinder core 32*a* with a pivoted part 34 formed in one piece, which is accommodated rotatably in the locking mechanism 32. The locking cylinder core 32*a* is not rotatable in relation to the locking mechanism 32 when the key (not shown) has been withdrawn, taking thereby the position shown in FIGS. 1 and 2, and may be rotated clockwise from the position shown in FIGS. 1 and 2 after the key has been inserted.

The ratchet body guide element 24 has a rotation-catching aperture 24*a* in which the pivoted part 34 engages. The ratchet body guide element 24 is located on said pivoted part 34 of the locking cylinder core 32*a*.

Figure 2:
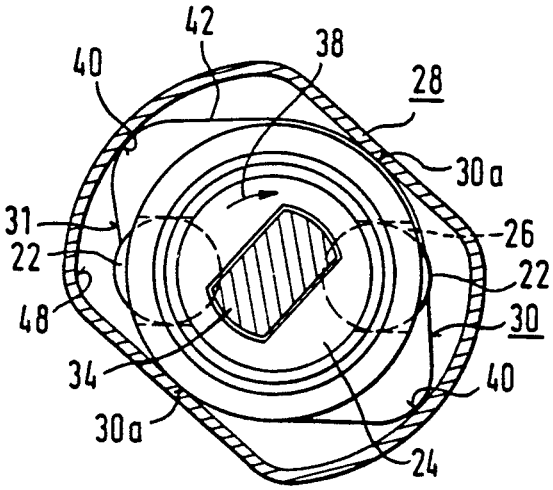
FIG. 2 show a cross-section taken on the line II—II in FIG. 1.

To open the locking device, the key is inserted and rotated clockwise in the direction of arrow 38 of FIG. 2, so that the locking cylinder core 32*a* is, together with the pivoted part 34 and thus together with the ratchet body guide element 24, rotated clockwise, until the ratchet balls 22 reach guide surface areas 40 of the guide surface 30 and can move radially outwards with respect to the axis X—X (second evasion position of the ratchet body guide element 24). The guide surface areas 40 of the guide surface 30 are formed in a way that the guide surface 30 has a rhombic cross-section in its lower region as indicated at 42.

If the ratchet balls 22 are opposite the guide surface areas 40, they can, as the connecting part 14 is withdrawn, move radially outwards (evasion movement of the ratchet balls 22) so that the connecting part 14 can be drawn out of the connecting part case 16. The displacement of the ratchet balls 22 in a radially outward direction is possible by means of a corresponding profiling of the throat 18 and especially by the fact that the ratchet shoulder 20 takes its bearing on the ratchet balls 22, in fact in a position radially inwards of the centre of the ratchet balls 22.

The ratchet body guide element 24 is, by means of a coil spring 44 which is attached to it, pushed downwards towards a lower stopping surface 46 of the housing 28. Simultaneously, the ratchet body guide element 24 is subject to a torsional pretension, evoked through the coil spring 44, which tries to move the ratchet body guide element 24 into a position in which the ratchet balls 22 bear on the guide surface areas 31. To fix the coil spring 44, one end of the spring 44 is inserted into a location hole 24*b* of the ratchet body guide element 24 (see FIGS. 4 and 7).

After disengaging the connecting part 14 and releasing the key, the ratchet body guide element 24 then returns into the position, through the effect of the coil spring 44, in which the ratchet balls 22 bear on the guide surface areas 31 (ready position for locking of the ratchet body guide element 24). The ratchet balls 22 cannot fall out of the guide passages 26 in a radially inward direction, despite the disengagement of the connecting part 14, because the guide passages 26 are narrow at their radially inner ends and therefore retain the ratchet balls 22.

To engage the connecting part 14 in the connecting part case 16 anew, it is not necessary to use a key. In this case the connecting part 14 is, referring to the description of the locking device in FIG. 1, inserted in the bell-shaped ratchet body guide element 24 from below and engages the ratchet balls 22. As the ratchet balls 22 take their bearing on the guide surface areas 31, they cannot move radially outwards for the moment, but the ratchet body guide element 24 is shifted upwards by engagement of the ratchet balls 22 with the connecting part 14 pressed upwards against the effect of the coil spring 44, whereby the ratchet body guide element 24 is shifted upwards on the pivoted part 34 of the locking cylinder core 32*a* (see FIG. 7). In this case, the ratchet balls 22 reach guide surface areas 48 of the guide surface 30 as a result of the upward movement of the ratchet body guide element 24 (first evasion position of the ratchet body guide element 24). To form these guide surface areas 48, the housing 28 is enlarged at the level of the cross-section II—II in relation to the rhombic cross-section 42 in the lower region. When the ratchet balls 22 come onto the guide surface areas 48, they are urged by a displacement bevel 50 for the ratchet body 22 at the upper end of the connecting part 14 into a radially outward direction until such time that the ratchet shoulder 20 has passed over the ratchet balls 22 and the ratchet balls 22 can go back into the throat 18. When the insertion pressure onto the connecting part 14 is removed, the ratchet body guide element 24 moves back downwards under the pressure of the coil spring 44. The ratchet balls 22 reach again the guide surface areas 31 and are thereby again pressed into the throat 18 of the connecting part 14 in a radially inward direction, so that the state according to FIGS. 1 and 2 is restored (locking position of the ratchet body guide element 24). The movement of the ratchet balls 22 in a radially inward direction can, in this case, be biassed by an eleastic O-ring 52 which bears on the part situated radially outwards of the ratchet balls 22 and forces the ratchet balls 22 radially inwards.

The locking mechanism 32 is accomodated inside the housing 28 in a reinforced inner casing or inner housing 54 which is held in its built-in position by bumps 56 of the housing 28 fitting in corresponding recesses 58 at the lower end of the inner housing 54. At the upper end the inner housing 54 is secured by a covering plate 60 held by a flange 62 of the housing 28. The coil spring 44 supports itself in an indentation 64 of the inner housing 54. The covering plate 60 and the flange 62 are annular so that they offer an access hole 66 for the key.

The locking mechanism 32 can be a conventional locking cylinder with the locking cylinder core 32*a* already described. The turning movement of the turning of the locking cylinder core 32*a* is determined inside the locking mechanism 32 in that way that at the one end of the movement the ratchet balls 22 bear on the guide surface areas 31 and at the other end of the movement the ratchet balls 22 are opposite the guide surface areas 40. The coil spring 44 imparts a pretension to the locking cylinder core 32*a* in the direction of the end position in which the ratchet balls 22 are opposite the guide surface areas 31 or bear on them.

The end 12 of the ring cable is together with a cable block 68 anchored in the inner housing 54, actually by means of a U-shaped clip 70 which is inserted into a slot 72 of the inner housing 54 before the covering plate 60 is placed in position and which enters in a ring groove 74 of the cable block 68. Through flattenings at the cable block 68 and corresponding counter flattenings in the inner housing 54, the cable block 68 is secured against torsion in relation to the inner housing 54.

Figure 3:
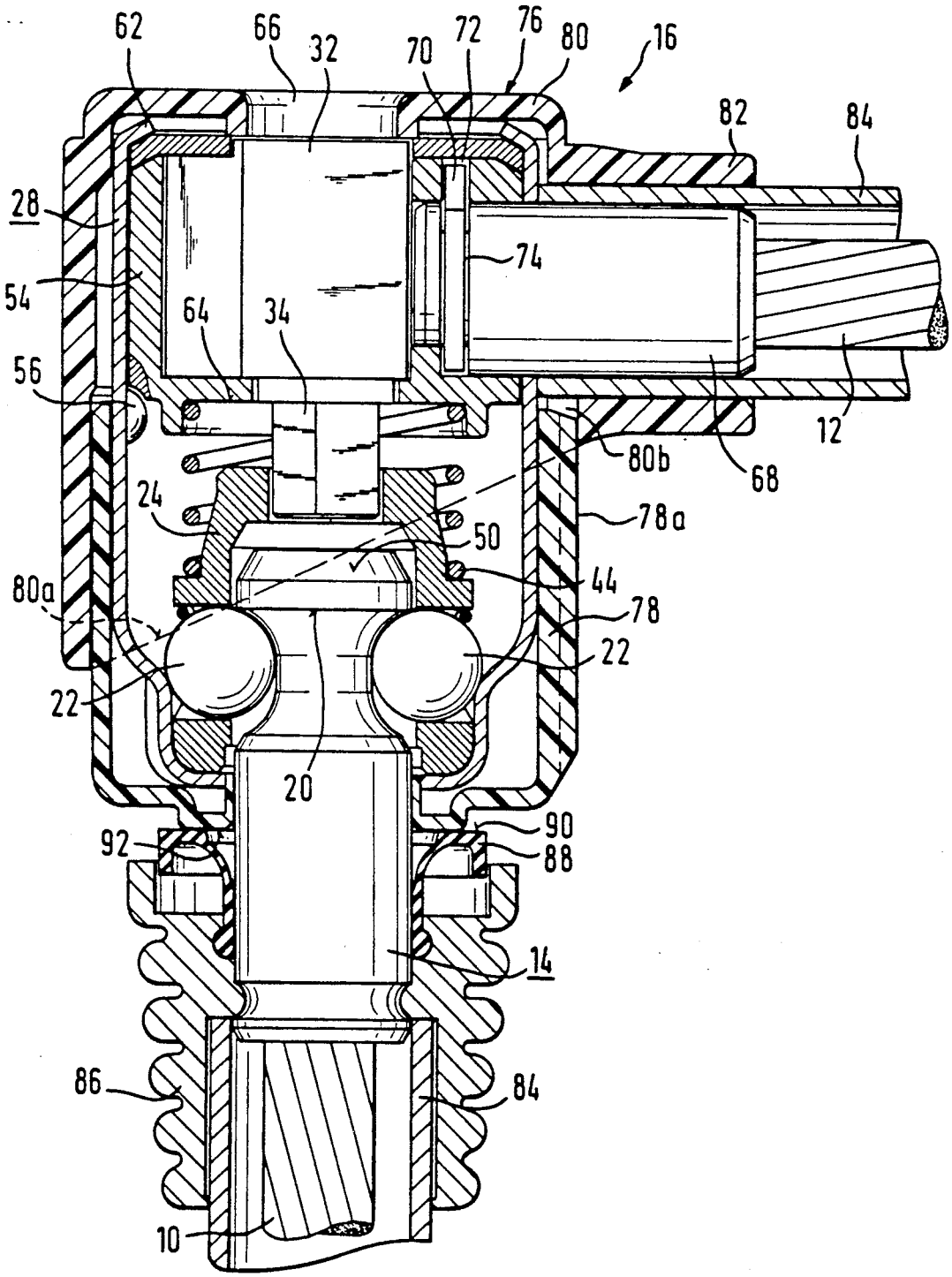
FIG. 3 shows a modification of the embodiment in FIG. 1.

FIG. 3 shows that the housing 28 is covered by a plastic coating 76. The plastic coating 76 consists of two coating parts 78 and 80 which are fitted together and interengaged. The coating part 80 comprises a cable lead through 82 which receives a tubular cable sheath or tube 84 enclosing the cable. The coating part 80 is shaped skew at its lower end 80*a* in a way such that it can be pushed over the flange 62 when the cable lead-through 82 is at the same time pushed towards the housing 28 and it then snaps into the position according to FIG. 3 in which it can be engaged with the coating part 78. A rib 78*a* of the coating part 78 thereby engages in a recess 80*b* of the coating part 80 so that the coating part 78 is held unrotatable.

In the region of the connecting part 14, the cable sheath 84 is enclosed by an end piece 86 which also encircle the connecting part 14. A silicone rubber bush 88 is fitted to the connecting part 14 by the end piece 86 and bears with an end surface 90 under elastic pretension, on a bearing surface 92 of the coating part 78, so that a seal is formed which prevents ingress of dirt and moisture into the inside of the connecting part case 16 when the connecting part 14 is inserted.

The silicone rubber bush 88 being axially elastic has a further function since it generates a pretension on the connecting part 14 in an axially downward direction by which the ratchet shoulder 20 is pushed against the ratchet balls 22 so that the connecting part 14 and the ratchet balls 22 are held in the locked position without hanging loose.

It must also be mentioned that the ratchet body guide element 24 is guided axially shiftable and rotatable by guide areas 30*a* (See FIGS. 1 and 2) of the guide surface 30 in the lower region of the guide surface 30. These guide areas 30*a* are formed by curves of the rhombic lower housing part 42.

In FIGS. 4 to 8 a further embodiment of the locking device according to the invention is shown with the same components being given the same reference numerals as before. The locking device shown here differs from the locking devices shown in FIGS. 1 to 3 to the effect that it has a modified pivoted part 34'. This pivoted part 34' is provided with a portion 35*a* of smaller cross-section remote from the locking mechanism 32, which engages in the rotation-catching aperture 24*a* of the ratchet body guide element 24. In this case, a free motion of a swing angle between the rotation-catching aperture 24*a* and this portion 35*a* of smaller cross-section (see FIG. 5) exists which is, however, balanced by the rotational pretension produced by the coil spring 44 so that there is an interlocking rotation-catching connection between the portion 35*a* of smaller cross-section and the ratchet body guide element 24. In addition to that, the pivoted part 34' has a portion 35*b* of larger cross-section close to the locking mechanism 32, which engages in the rotation-catching aperture 24*a* when the ratchet body guide element 24 is in its first evasion position (see FIG. 7). The portion 35*a* of smaller cross-section and the portion 35*b* of lager cross-section are both formed by two flattenings of the cylindrical pivoted part 34' arranged parallel to each other, the portion 35*a* being twisted in relation to the portion 35*b* in the direction of the circumference around an angle of especially between 2 and 10 degrees, preferably of 6 degrees (see FIG. 6*a*, 6*b*). The transition of the portion 35*a* of smaller cross-section to the portion 35*b* of larger cross-section is formed by ramp-like transitional surfaces 35*c* which have in relation to the axis of the pivoted part 34' an angle especially between 40 and 60 degrees, preferably of 50 degrees. The axial length of the two surfaces of the portion 35*a* of smaller cross-section arranged parallel to each other basically corresponds to the insertion depth of this portion 35*a* into the rotation-catching aperture 24*a* in the basic position of the locking device.

If the ratchet body guide element 24 is displaced out of its basic position, in which the portion 35*a* of smaller cross-section of the pivoted part 34' engages in the rotation-catching aperture 24*a*, by the insertion of the connecting part 14 into its first evasion position axially along the pivoted part 34', the transitional surfaces 35*c* force a relative rotation of the ratchet body guide element 24 in relation to the pivoted part 34' against the pretension of the coil spring 44 when the portion 35*b* of larger cross-section enters the rotation catching aperture 24*a* (see FIGS. 7 and 8).

The portion 35*a* of smaller cross-section, the portion 35*b* of larger cross-section and the transitional surface 35*c* together form a catch mechanism. This catch mechanism can be easily overcome when the connecting part 14 is inserted in accordance with the normal operation into the connecting part case 16, a slight torsion of the ratchet body guide element 24 occurring in regard to the pivoted part 34' around the angle of 2 to 10 degrees, preferably approximately 6 degrees. On the other hand, the transitional surfaces 35*c* prevents the ratchet body guide element 24 from sliding onto the portion 35*b* of larger cross-section with a relative acceleration of the connecting part 14 and the connecting part case 16 and the ratchet body guide element therewith comes into an evasion position in which the ratchet balls 22 can move in a radially outward direction. Therefore unintended opening of the locking device is prevented when sudden forces of gravity occur and the functional safety of the locking device is further increased.

What is claimed is:

1. A locking device for a lock, comprising:

a connecting part (14) having a ratchet shoulder (20);

connecting part receiving means (16) having an insertion axis (X—X) and a locking means (32) for releasably locking said connecting part (14) therein;

said connecting part (14) being insertable into said connecting part receiving means (16) along said insertion axis (X—X) and being snappingly engageable therein in response to such insertion and being releasable from said snapping engagement by manual actuation of said locking means (32);

said connecting part receiving means (16) including a ratchet body guide element (24) having at least one guide passage (26) substantially transverse to said insertion axis (X—X), said at least one guide passage (26) accommodating a ratchet body (22) which is movable within said guide passage (26) in a direction substantially transverse to said insertion axis (X—X) between an engagement position, in which said ratchet body (22) engages said ratchet shoulder (20) so as to lock said connecting part (14) within said connecting part receiving means (16), and a releasing position, in which said ratchet body (22) is out of engagement with said ratchet shoulder (20) so as to permit said connecting part (14) to be released from said connecting part receiving means (16);

guide surface means carried by said connecting part receiving means (16) for controlling transverse movement of said ratchet body (22), said guide surface means including a guide surface (30) which is engageable with said ratchet body (22) at an end portion thereof remote from said connecting part (14) when said connecting part (14) is inserted into said connecting part receiving means (16);

said ratchet body guide element (24) being axially movable along said insertion axis (X—X) with respect to said guide surface (30), in response to said connecting part (14) being axially inserted into said connecting part receiving means (16), from a locking position, in which said ratchet body (22) is urged transversely by said guide surface (30) into locking engagement with said ratchet shoulder (20), to a first evasion position, in which said guide surface (30) permits transverse disengagement of said ratchet body (22) from said ratchet shoulder (20);

said ratchet body guide element (24) being rotatable about said insertion axis (X—X) through said locking mechanism (32) from said locking position to a second evasion position with respect to said guide surface (30), at which second evasion position said guide surface (30) permits transverse disengagement of said ratchet body (22) from said ratchet shoulder (20) of said connecting part (14); and said guide surface (30) being of varying radial distance from said insertion axis (X—X) and having a locking face element (31) radially aligned with said end portion of said ratchet body (22) in said locking position of said ratchet body guide element (24), a first releasing face element (48) radially aligned with said end portion of said ratchet body (22) in said first evasion position of said ratchet body guide element (24), and a second releasing face element (40) radially aligned with said end portion of said ratchet body (22) in said second evasion position of said ratchet body guide element (24), the radial distance between said guide surface (30) and said insertion axis (X—X) varying in substantially the same sense both when progressing in the axial direction from said locking face element (31) towards said first releasing face element (48) and when progressing in the circumferential direction from said locking face element (31) towards said second releasing face element (40).

2. A locking device according to claim 1, wherein said connecting part receiving means (16) includes means for pretensioning the ratchet body guide element (24) into the locking position.

3. A locking device according to claim 2, wherein said pretensioning means includes a coil spring (44) for simultaneously pretensioning said ratchet body guide element (24) towards said locking position in both axial and circumferential directions.

4. A locking device according to claim 1, wherein:

said connecting part receiving means (16) includes a housing (28); and said guide surface means is formed on the inner surface of said housing (28).

5. A locking device according to claim 1, wherein:

said locking mechanism (32) includes an axial-extending rotatable part (34, 34'); and said ratchet body guide element (24) is guided for axial movement on said rotatable part (34, 34') and is in torque-transmitting connection therewith.

6. A locking device according to claim 1, wherein said guide surface means comprises means (30*a*) for guiding said ratchet body guide element (24) for axial and rotatable movement.

7. A locking device according to claim 1, further comprising a plurality of ratchet bodies (22) spaced at substantially equal intervals about the circumference of the connecting part (14).

8. A locking device according to claim 5, wherein:

said ratchet body guide element (24) is generally bell-shaped in axial cross section; and said ratchet body guide element (24) is axially guided on said rotatable member (34, 34') in the apex region of said bell-shaped cross section.

9. A locking device according to claim 4, wherein the housing (28) encloses the locking mechanism (32).

10. A locking device according to claim 3, wherein the coil spring (44) is supported by the locking mechanism (32).

11. A locking device according to claim 1, wherein the connecting part (14) and the connecting part receiving means (16) are connected to the respective ends (10, 12) of a cable of a ring lock.

12. A locking device according to claim 11, wherein:

said connecting part receiving means (16) includes an inner housing (54) which encloses said locking mechanism (32); and said end (12) of said ring lock cable connected to said connecting part receiving means (16) is anchored to said inner housing (54).

13. A locking device according to claim 1, wherein said connecting part receiving means (16) includes means (52) for biasing said ratchet body (22) towards engagement with said connecting part (14).

14. A locking device according to claim 13, wherein:

said ratchet body guide element (24) includes a plurality of said guide passages (26), each of said guide passages accommodating a ratchet body (22) for said transverse movement therein; and said biasing means (52) comprises an elastic ring (52) encircling said ratchet bodies (22) and urging said ratchet bodies radially inward towards said connecting part (14).

15. A locking device according to claim 1, wherein said guide surface (30) extends between said locking face element (31) and both said first and second releasing face elements (48, 40) along substantially continuous lines of curvature.

16. A locking device according to claim 1, wherein the ratchet body (22) comprises a ratchet ball.

17. A locking device according to claim 1, wherein said connecting part (14) includes a bevel (50) axially forward, in the direction of insertion of said connecting part (14) into said connecting part receiving means (16), of said ratchet shoulder (20) for displacing said ratchet body (22) from said engaging position.

18. A locking device according to claim 1, wherein said connecting part receiving means (16) includes means for pretensioning said locking mechanism (32) towards said locking position of said ratchet body guide element (24).

19. A locking device according to claim 1, wherein the locking mechanism (32) comprises a key-operated cylinder lock.

20. A locking device according to claim 12, wherein:

said connecting part receiving means (16) includes an outer housing (28) enclosing said inner housing (54); and said outer housing (28) bears against and supports said inner housing (54) over at least a part of the inner surface of said outer housing (28).

21. A locking device according to claim 1, wherein:

said connecting part (14) is axially movable relative to said ratchet body (22) when said ratchet body is in said engagement position; and resilient means (88) are provided between said connecting part (14) and said connecting part receiving means (16) for urging said connecting part (14) axially outwardly of said connecting part receiving means (16), so as to urge said ratchet shoulder (20) into axial engagement with said ratchet body (22).

22. A locking device according to claim 21, wherein said resilient means (88) is carried by the connecting part (14) and bears against a bearing surface (92) on the connecting part receiving means (16).

23. A locking device according to claim 22, wherein said resilient means (88) comprises an annular member made of silicone rubber.

24. A locking device according to claim 21, wherein said resilient means (88) comprises a seal element which provides a seal between the connecting part (14) and the connecting part receiving means (16) when the connecting part (14) is inserted into the connecting part receiving means (16).

25. A locking device according to claim 1, wherein the connecting part receiving means (16) is enclosed by a rubber or plastic coating (76).

26. A locking device according to claim 25, wherein said coating (76) is comprised of at least two parts (78 and 80) which are connected with each other.

27. A locking device according to claim 26, wherein:

said connecting part (14) and said connecting part receiving means (16) are connected to the respective ends (10, 12) of a ring lock cable; and said coating (76) is connected to a tube (84) which encloses said ring lock cable.

28. A locking device according to claim 27, wherein:

the end of said tube (84) connected to said connecting part (14) is connected to an elastomeric element (88) which surrounds said connecting part (14); and when said connecting part (14) is engaged in said connecting part receiving means, said elastomeric element (88) bears axially against said coating (76) and forms a seal therewith.

29. A locking device according to claim 5, further comprising catch means (35*a–c*) provided between said rotatable part (34') and said ratchet body guide element (24) for permitting axial movement of said ratchet body guide element (24) relative to said rotatable part (34') upon insertion of said connecting part (14) by hand into said connecting part receiving means (16) and for preventing impulsive axial movement of said ratchet body guide element (24) relative to said rotatable part (34') due to acceleration of said connecting part receiving means (16).

30. A locking device according to claim 5, further comprising rotation-imparting means provided between said ratchet body guide element (24) and said rotatable part (34') for imparting rotational movement to both said ratchet body guide element (24) and said rotatable part (34') upon axial movement of said ratchet body guide element (24) relative to said rotatable part (34').

31. A locking device according to claim 30, wherein:

said ratchet body guide element (24) includes an axially-directed rotation-transmitting aperture (24*a*) in the axially-inner end thereof;

said rotatable part (34') includes an outer axial portion (35*a*) of smaller cross-sectional size, an inner axial portion (35*b*) of larger cross-sectional size, and ramp-like transitional surfaces (35*c*) joining said outer and inner axial portions (35*a*, 35*b*), the cross sections of said outer and inner axial portions (35*a*, 35*b*) generally conforming in shape to the cross sectional shape of said aperture (24*a*);

said outer axial portion (35*a*) being received in said aperture (24*a*) when said ratchet body guide element (24) is in said locking position, the difference in cross-sectional size between said aperture (24*a*) and said outer axial portion (35*a*) permitting limited free rotational movement between said ratchet body guide element (24) and said rotatable part (34');

means for rotationally biasing said ratchet body guide element (24) relative to said rotatable part (34') to take up said limited free rotational movement; and said inner axial portion (35*b*) being received in said aperture (24*a*) when said ratchet body guide element (24) is in said first evasion position, said ramp-like surfaces (35*c*) causing a relative rotational movement between said ratchet body guide element (24) and said rotatable part (34') when the ratchet body guide element (24) is moved axially inward by hand from engagement with said outer axial portion (35*a*) into engagement with said inner axial portion (35*b*).

* * * * *